US005398928A

United States Patent [19]

Rudell et al.

[11] Patent Number: 5,398,928

[45] Date of Patent: * Mar. 21, 1995

[54] FOOTBALL WITH TAIL APPENDAGE

[75] Inventors: Elliot Rudell, Rancho Palos Verdes; George Foster, Signal Hill, both of Calif.

[73] Assignee: Elliot A. Rudell, Torrance, Calif.

[ * ] Notice: The portion of the term of this patent subsequent to Jul. 20, 2010 has been disclaimed.

[21] Appl. No.: 156,547

[22] Filed: Nov. 23, 1993

[51] Int. Cl.[6] ..... A63B 43/02

[52] U.S. Cl. ..... 273/65 EF; 273/65 EC; 273/65 EG; 273/58 K; 273/DIG. 30; 434/251

[58] Field of Search ..... 273/55 R, 58 K, 65 EF, 273/65 EC, 65 EG, DIG. 30; 434/251

[56] References Cited

U.S. PATENT DOCUMENTS

| | | | |
|---|---|---|---|
| 3,042,404 | 7/1962 | Masters | 273/55 R |
| 3,225,488 | 12/1965 | Goldfarf | 273/65 EF X |
| 3,256,020 | 6/1966 | Smith | 273/65 EF |
| 3,940,133 | 2/1976 | Civita | 273/58 C |
| 4,657,253 | 4/1987 | Lerner et al. | 273/58 K X |
| 5,228,690 | 7/1993 | Rudell et al. | 273/58 K X |

OTHER PUBLICATIONS

Barr Rubber Products Co., 1965 Athletic Ball Catalog.

*Primary Examiner*—George J. Marlo

*Attorney, Agent, or Firm*—Blakely, Sokoloff, Taylor & Zafman

[57] ABSTRACT

A football having an end appendage comprising at least one long, narrow strip of a flexible sheet material, e.g., cloth of flexible plastic, which functions as a tail when the ball is thrown or kicked and which provides directional stability for the football while in flight. When multiple strips are used which are formed of a rigidly flexible sheet such as MYLAR, the appendage also functions as a sound generator. When the football is thrown in a normal manner, the tail extends backwards, providing a slight drag to cause the back tip of the ball to align itself with the front rip, thereby resulting in the straight and accurate flight of the ball. One end of the appendage is preferably detachably/attached to an end of the football by interlocking hook and loop material, commonly known as VELCRO.

1 Claim, 7 Drawing Sheets

FIG. 1
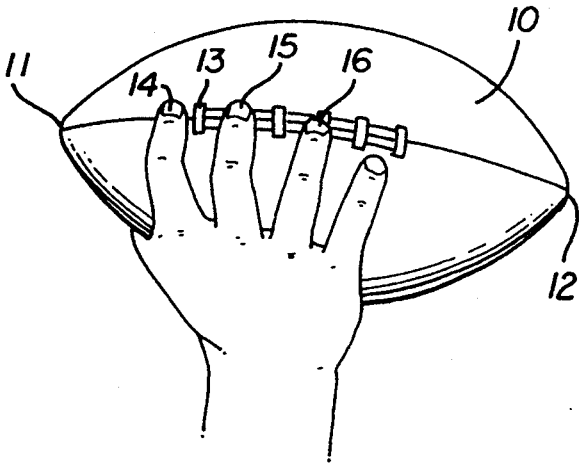
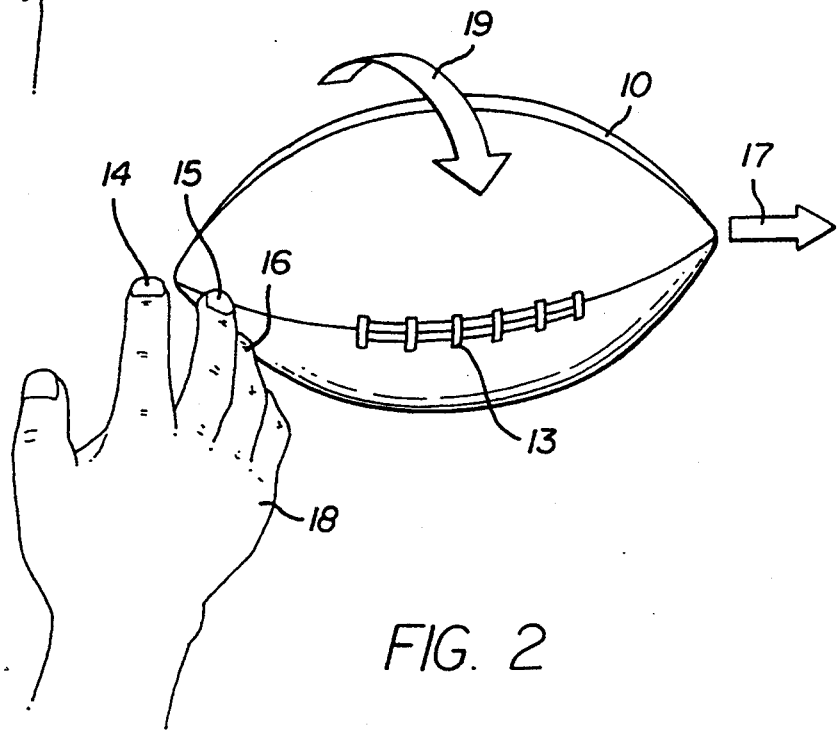
FIG. 2
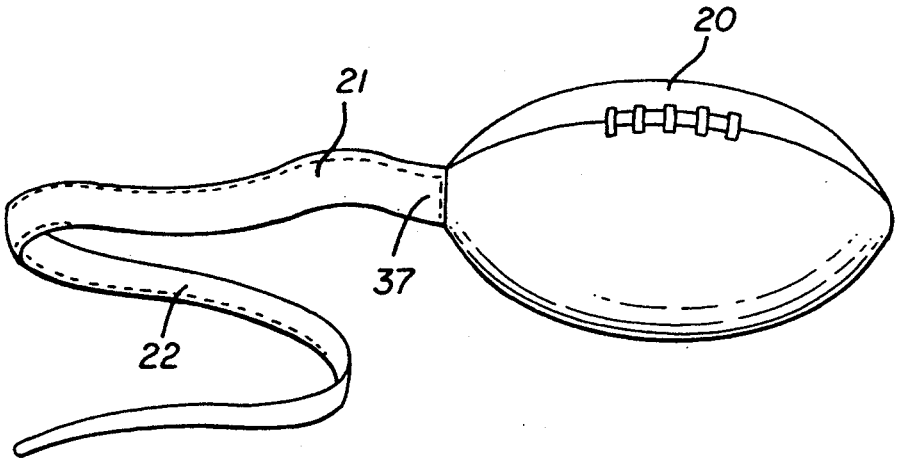
FIG. 3

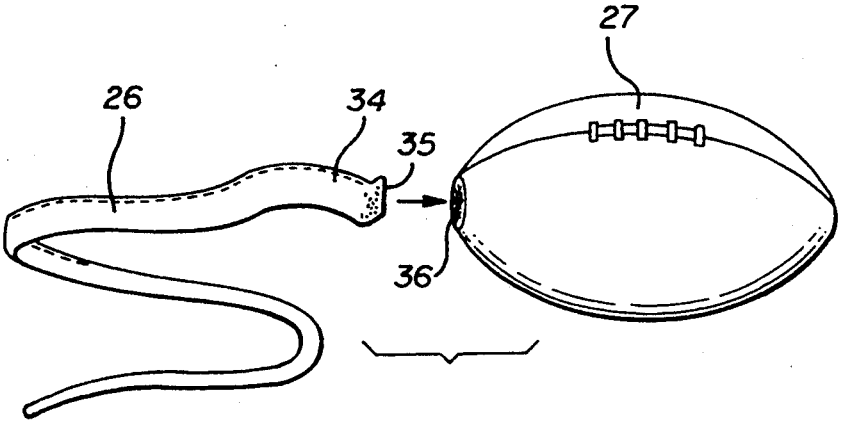
FIG. 6
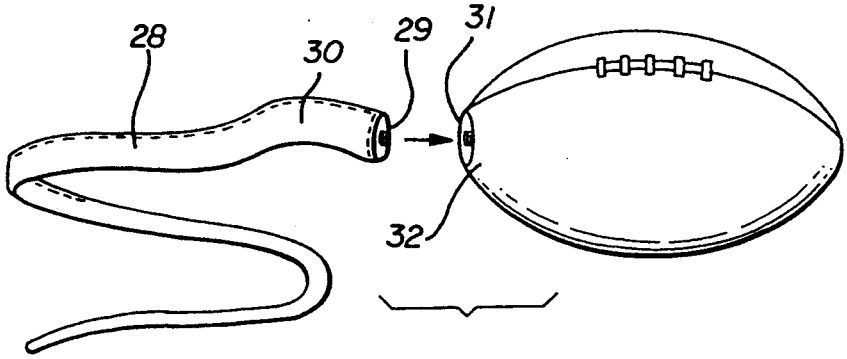
FIG. 7
FIG. 9
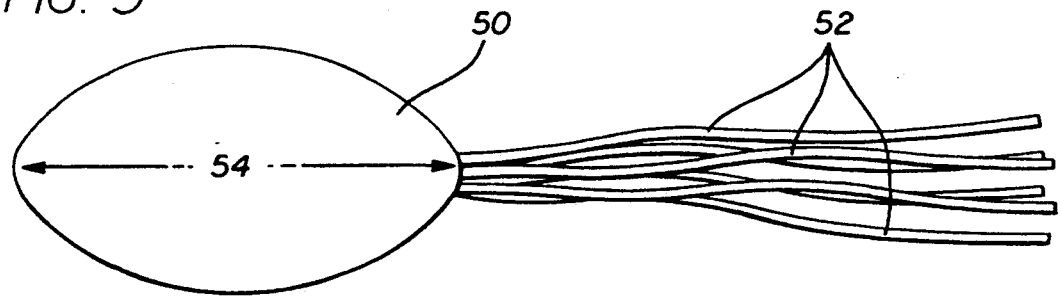
FIG. 10
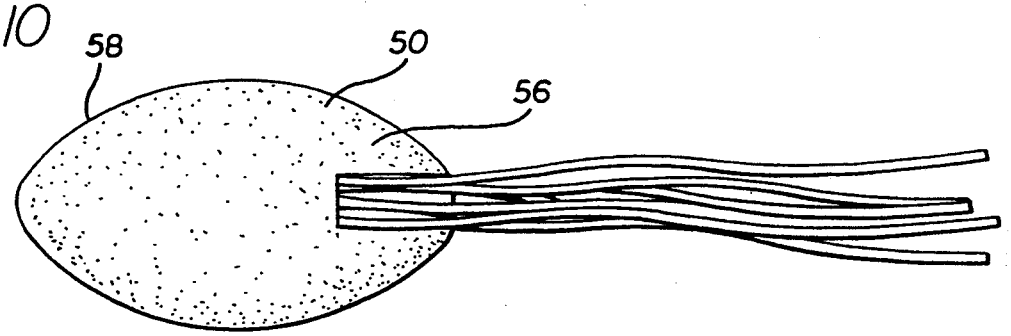

FIG. 16A
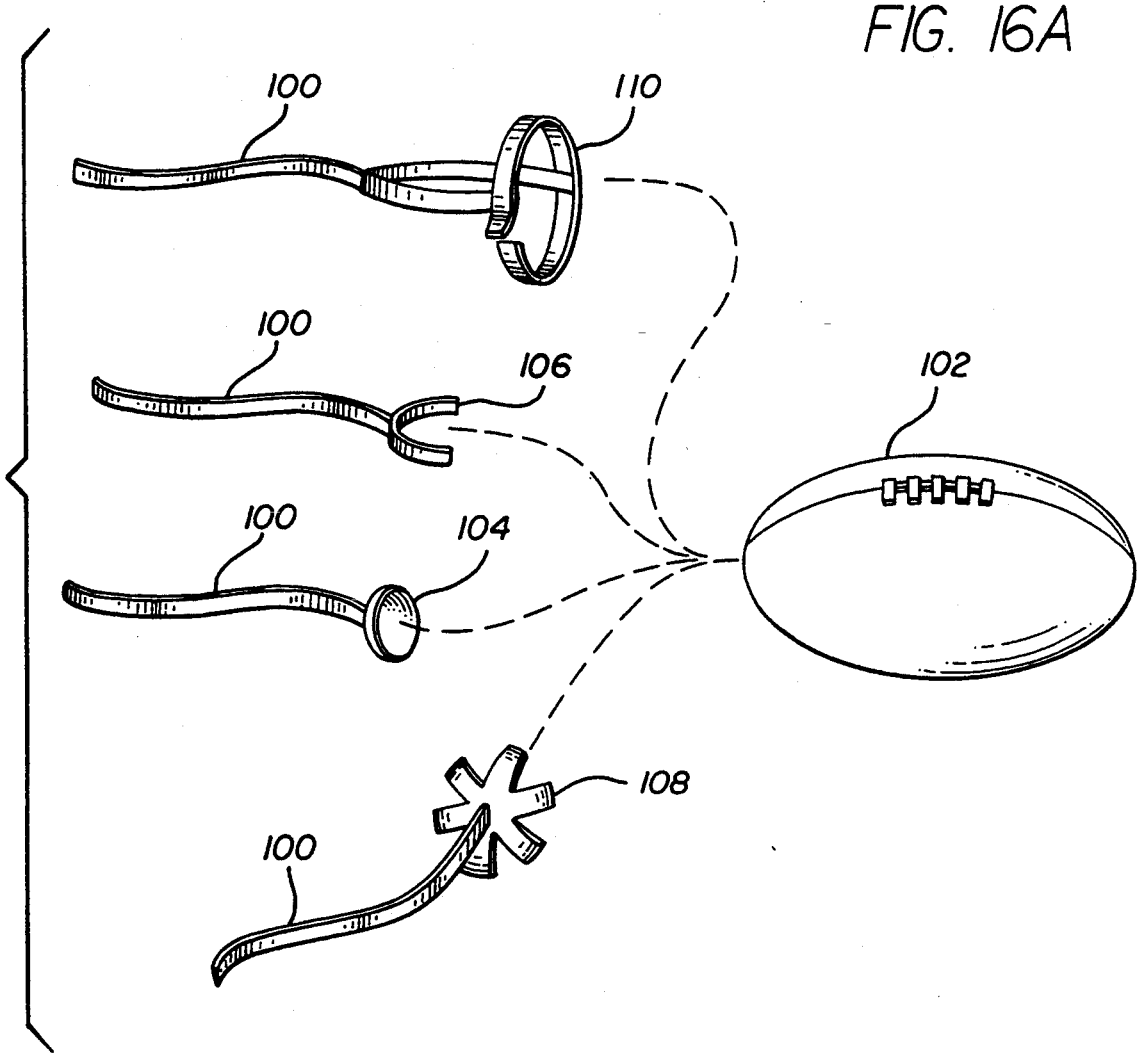
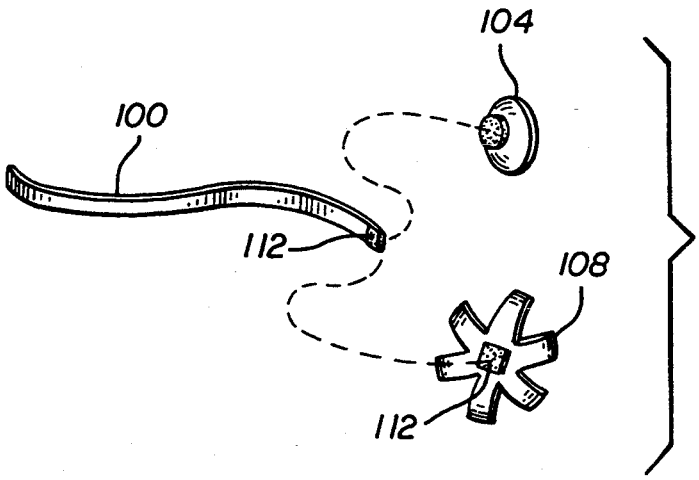
FIG. 16B

FOOTBALL WITH TAIL APPENDAGE

BACKGROUND OF THE INVENTION

1. Field of the Invention

The present invention relates to the sport of football and, in particular, to improvements to a football to provide superior throwing capabilities for all ages of participants, particularly those first learning how to throw a football who might otherwise have difficulty causing the ball to throw properly.

2. Description of Related Art

The effective throwing of a football has always been considered somewhat of an art. It is necessary that the thrower release the ball in such a manner to impart a spiraling or spinning motion to the ball. This results in the spinning of the ball as it travels through the air and causes its flight to be directionally controllable and straight. Children experience the greatest difficulty in effecting this spiral action. The most notable prior art effort to improve this performance is currently being marketed by Parker Brothers, a division of Tonka Corporation, The product is called NERF TURBO FOOTBALL, and is basically a toy football molded of soft foam with fluted ribs molded in its external surface, longitudinally from end to end. These ribs effect the aerodynamics of the ball and result in a somewhat better flight pattern, if the child can master the throw. The ribs, however make the ball look noticeably strange. Parker Brothers, along with many other toy companies, also market soft foam footballs with no surface variations. These soft foam balls are easier to throw and catch by youngsters due to their tactile feel and softness.

The employment of a cloth tail on round balls has been done in the past. Mattel Toys marketed such a product in the early 1970's, called FLYIN LION. It consisted of a circular ball with a flexible nylon or vinyl appendage that served as a decorative tail with which the ball could also be caught. U.S. Pat. No. 4,826,179, discloses tails affixed to a round, weighted ball to creating a challenging situation as the wafting tail segments pass a receiver in a relatively rapid and unpredictable flight pattern.

VELCRO has been used on balls before, but always with the intent of providing a contact surface with which the ball can adhere to a remote object covered with the corresponding VELCRO material. To our knowledge, the employment of VELCRO on two removable sections of a ball projectile to provide separation removable attachment of those sections, has never before been suggested.

Regarding balls whereon one half of the VELCRO system is employed for contact with a remote object, Lemelson U.S. Pat. No. 3,032,345 describes a target game wherein VELCRO is mounted on the surface of a projectile dart to effect its adherence to a compatibly equipped target area. Other Lemelson U.S. Pat. Nos. 3,927,881, 3,857,566 and 3,917,271 also describe the employment of VELCRO for the purposes of adhering a projectile to a target surface. Guinn, U.S. Pat. No. 4,447,060, also describes a target game wherein the adherence of the projectile to the target is effected by VELCRO.

VELCRO covered projectiles such as balls is a commonplace occurrence. A now defunct St. Louis manufacturer named Impulse, Ltd. recently marketed children's baseballs and gloves, footballs and gloves, and flying discs and gloves wherein the entire surface of each of the items, as well as significant areas of the gloves, were covered in the hook and loop design material commonly referred to as VELCRO to enable the users to catch the items better. It should be noted that the total intent of these items was to improve catchability. It was impossible to throw and thereby release the projectile from the gloves once it became attached, due to the inherent nature of the design. The VELCRO firmly locked the balls to every surface of the gloves.

In no prior art has it ever been disclosed to attach either a permanent, or removable, appendage to a football-shaped ball for the purpose of providing both a stabilizing function to improve directional throwing as well as to provide a grip surface for catching, holding while practicing kicking, or for grabbing by an opponent.

SUMMARY OF THE INVENTION

This invention comprises a football having an appendage which is a long, narrow flexible sheet material, e.g., cloth or flexible vinyl, which functions as a tail when the ball is thrown or kicked and which provides directional stability for the football while in flight. When the football is thrown in a normal manner, the tail extends backwards, providing a slight drag to cause the back tip of the ball to align itself with the front tip, thereby resulting in the straight and accurate flight of the ball. The appendage can be constructed to be attached to and removed from the football by the user.

It is an objective of this invention to modify a football to render it easier to impart a spiraling motion to the ball.

It is a further object of this invention to provide a football which is modified for use as a training aid useful in acquiring skill in throwing a football.

It is an additional object of this invention to provide a toy football.

It is also an objective of this invention to provide a football which is modified to improve its aerodynamics.

It is a specific objective of this invention to provide a football with a tail which causes the ball to spiral through the air and travel straighter.

It is also an objective of this invention to provide a football for use by all players, particularly children, that is easier to throw and control than conventionally shaped footballs.

It is also an objective of this invention to provide a football for children that exhibits beautiful colors and a streamer-like look, like a kite tail, as it is thrown through the air.

It is also an objective of this invention to provide a football that can be held by its flexible tail by a child while he practices kicking the football as it hangs from the tail.

It is also an objective of this invention to provide a football that has a removable tail section which can be grabbed by an opponent and removed from the ball to designate a game event, e.g., a tackle, or the end of a play.

It is also an objective of this invention to provide a stabilizer appendage which can be attached to and removed from a football by a user.

BRIEF DESCRIPTION OF THE DRAWINGS

The objects and advantages of the present invention will become more readily apparent to those ordinarily skilled in the art after reviewing the following detailed description and accompanying drawings, wherein:

FIG. 1 illustrates a typical football;

FIG. 2 illustrates the throw of a typical football;

FIG. 3 illustrates a football with a tail appendage;

FIG. 6 illustrates the football of the invention with a removably attached tail appendage connected by VELCRO hook and loop material;

FIG. 7 illustrates the football of the invention with a removably attached tail appendage connected by a snap fitting;

FIGS. 9 and 10 illustrates an embodiment of the invention which uses multiple tail appendages;

FIG. 16*a* illustrates alternate embodiments of appendages which can be detachably attached to a football;

FIG. 16*b* illustrates an appendage of FIG. 17*a* which is attached to an attachment member by hook and loop material;

DETAILED DESCRIPTION OF THE INVENTION

Figure 4:
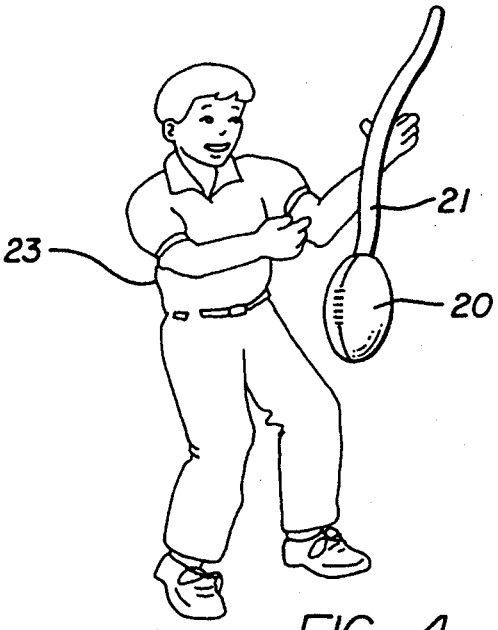
FIG. 4 illustrates a person catching the football of the invention after it has been thrown by another person.

Referring now to FIG. 1, a typical American football 10 is illustrated. The ball 10 is ovaloid, with a circular transverse cross section and an elliptical longitudinal cross section, having its greatest length being from end 11 to end 12. The football 10 has threads 13, which are either actually stitched threads, or, in the case of toy footballs which are often molded of a closed cell foam material, molded-in threads. The thrower grasps the ball in a manner as shown, with several fingertips 14, 15 and 16 resting on or over the threads.

Referring now to FIG. 2, the path 17 of the ball 10 is illustrated. As the thrower moves his hand 18 forward, illustrated by arrow, and releases the ball 10 his fingers 14, 15 and 16 interact with the threads 13, effecting a spiral motion of the ball, as illustrated by arrow 19. This spiraling motion causes the ball 10 to travel straight, and with greater velocity. This is similar to the practice of rifling the inside surface of a gun barrel to impart a spin to the bullet and cause it to travel accurately. The skill required to release the ball 10 in such a manner as described herein requires skill and experience, and can often be frustrating to an inexperienced thrower. Children in particular often experience great difficulty with this skill. Even professional quarterbacks often release a football in less than the perfect manner as described herein; the result being a non-spiral, wobbly throw.

Referring now to FIG. 3, a football 20 of the invention is illustrated that bears a flexible long strip appendage resembling a tail 21. The tail 21 can be constructed of a strip 22 of durable cloth material, flexible vinyl or Nylon, or any similar substance that would provide durability and safe handling. For regulation size footballs, the tail 21 can be from 4 inches to 6 feet long, and have a width from 0.5 to 4 inches. Some manufacturers market smaller size footballs for young children, and the size of the tail size, of course, could be scaled down in proportion to the reduced size of the football while retaining the advantages of this invention.

The tail can be of constant width along its length, or can be tapered with its greatest width at the attachment end 37 of the fabric strip. It has been found that favorable results are achieved when the tail is narrower at the attachment end. A longer tail increases directional propensity, but also increases drag. It has been found that a tail 21 between 2 and 4 feet, and of moderate width, e.g., from 0.5 to 3 inches, is most efficient, providing sufficient directional stability while not creating too much drag or adding too much extra weight. The material for the tail 21 can be folded over and stitched, as shown, for double thickness, if desired.

As shown in FIG. 4, a player 23 is catching the football 20 of the invention by the appendage tail 21 after it has been thrown by another person, not shown. The catching of the tail 21 is not easy, but it does provide an extra skill challenge to players of a throwing and catching game, so that the ball 20 is caught by the tail 21 before the ball 20 strikes the ground. Often a player will get his hands on a thrown football, but will then bobble or juggle it in the air, trying to catch it, often causing it to drop to the ground. In those instances, the attached tail 21 is of great advantage as it provides greater opportunity for grasping the football 20. The thrown football, once touched by the intended recipient, can be bobbled up into the air, and the tail 21 provides a ready grabbing member for a successful catch.

Figure 5:
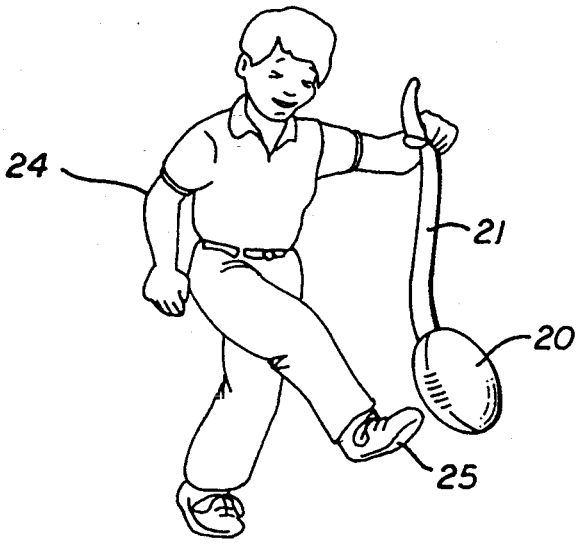
FIG. 5 illustrates a person holding the football of the invention for the purposes of practicing kicking.

Another activity associated with football is the kicking of the ball. To become proficient at kicking, a person must necessarily kick the ball and then retrieve it. Oftentimes large and costly net systems are employed for this purpose. Although the football 20 of the invention does not intend to duplicate the total kicking experience, it can be clearly seen, in FIG. 5, that a player 24 can practice the proper kicking form by holding a section of the tail 21, allowing the football 20 to dangle downward, and then kick at the dangling football 20 with his foot 25. For this usage, a non-removable tail 21 would be more desirable than a removable tail.

FIGS. 6 and 7 illustrate an embodiment of the invention whereby the tail 26 is removably attached to the football 27. In FIG. 6, the tail 26 is attached to the football 27 with attachment fabric tabs, having the conventional coating hook and loop fabrics, known as VELCRO. The attachment end 34 of the VELCRO fabric, with a tab 36 of coating VELCRO fabric permanently affixed to the football 27.

Referring now to FIG. 7, the tail 28 is attached with a conventional snap fitting, with a snap ring 29 on the attachment end 30 of the tail 28, and a snap fitting 31 of the end 32 of the football 33, thereby providing an easily removable attachment of the tail 28 to the football 33.

The embodiments shown in FIGS. 6 and 7 can be thrown as previously described, and one of two football games can be played, in addition to the other football games played with a conventional football.

Another embodiment of the invention is shown in FIGS. 9 and 10 where a ball 50 with a football shape is illustrated having a plurality of multiple tail appendages 52, each being relatively thin and narrow and of a length which is slightly longer than the length 54 of the ball. The particular ball 50 which is illustrated is formed with a plastic or rubber foam core 56 such as polyurethane foam. As shown in FIG. 10, the appendages 52 can be secured to the ball by embedding them in the foam core, preferably during formation of the core. Preferably the ball 50 has an exterior skin 58, which can be molded with simulated seams and lacing to provide an appearance similar to that of a conventional football. Alternatively, the covering can be plain or undecorated.

The number of appendages 52 can be varied, as desired, e.g., from 1 to 12 or more appendages can be provided. Preferably, when multiple appendages are used, they are equally sized and have a thickness from 0.001 to about 0.01 inches, a width from 0.1 to about 1.5 inches. The length of the appendage can be widely varied, and is somewhat dependent on the size of the ball. Typically, the length of the appendage, whether used as a single appendage or with others in a multiple appendage, can be from 0.25 to 10 times, preferably from 0.5 to 5 times, the length of the ball. The multiple appendages are uniformly distributed about the centerline of the ball and are preferably concentrated closely about the centerline, e.g., within a circular area about the centerline having a radius from 0.1 to 0.3 times the maximum radius of the ball, This insures maximum benefit of the appendages in stabilizing the trajectory of the ball.

When multiple appendages are formed of MYLAR (polyester) or similar rigidly flexible sheet material, a rustling sound is generated when the ball is thrown. Several toy footballs currently on the market have air-activated reed-like sound generators embedded in their outer surfaces. The multiple appendage tail of this invention, when formed of the rigidly flexible sheet material such as MYLAR, generates sound of substantially equal intensity to those footballs with reed-like sound generators.

Figure 11:
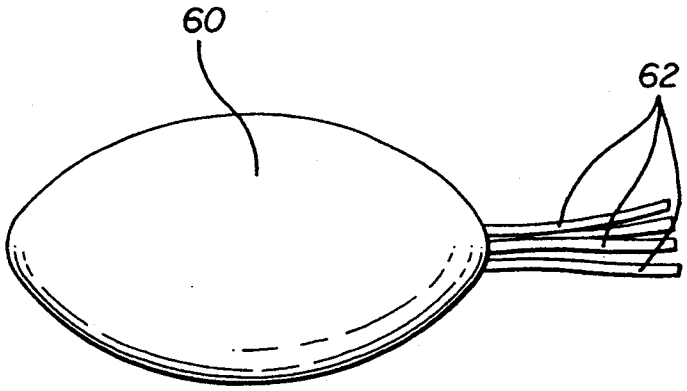
FIG. 11 illustrates an embodiment using short tail appendages.

FIG. 11 illustrates a ball 60 which is similar in shape and construction to that shown in FIGS. 9 and 10, with multiple, relatively short appendages 62. In this illustration, five appendages 62 having an exposed length of about one-fourth the length of the ball are secured to one end 64 of the ball 60.

Figure 12:
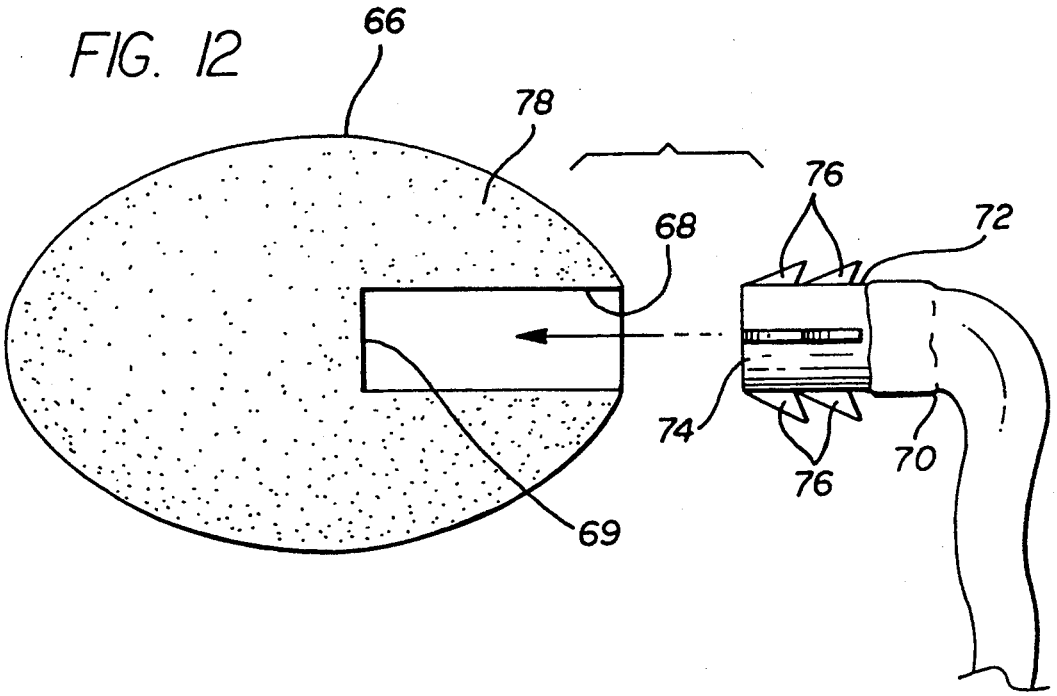
FIGS. 12 and 13 illustrate an embodiment having a retractable tail appendage.
Figure 13:
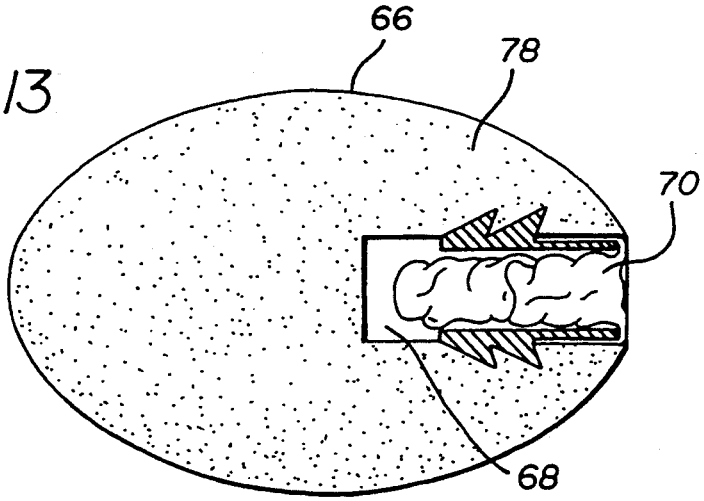
Figure 14:
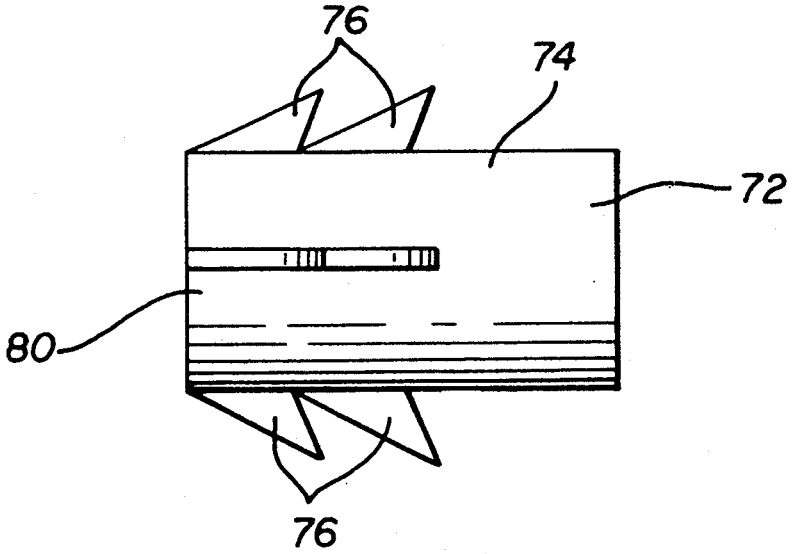
FIGS. 14 and 15 illustrate the appendage attachment sleeve used in the embodiment of FIGS. 13 and 14.
Figure 15:
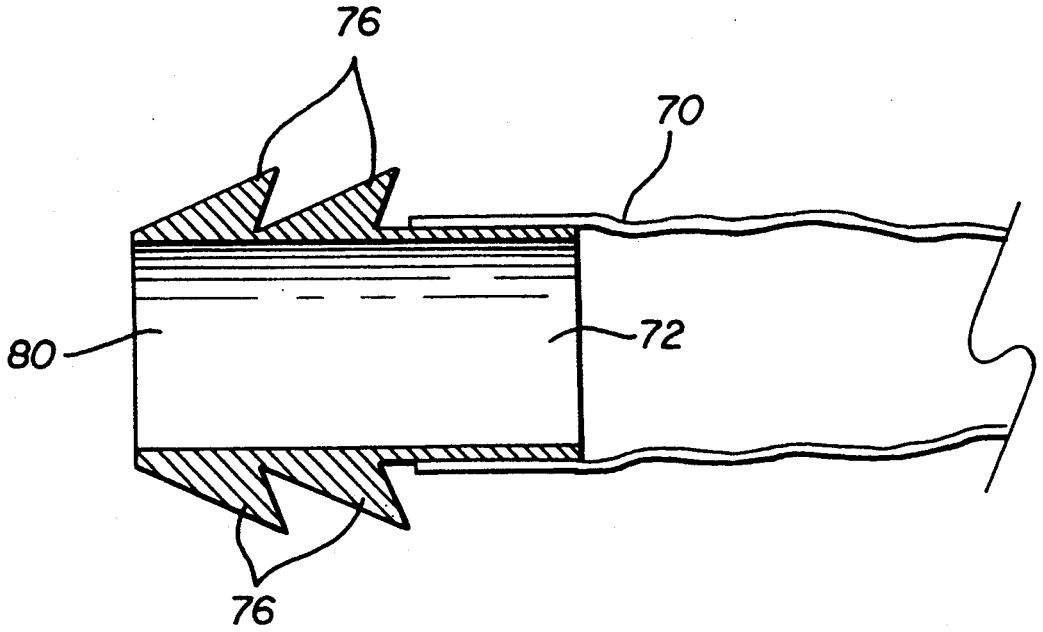

FIGS. 12 and 13 illustrate another embodiment in which a ball 66 is formed with an end recess which in the illustrated embodiment is a cylindrical cavity 68 that extends into the foam core of the ball approximately 30 to 40 percent of its length. The recess provides for storage of the tail appendage 70, as shown in FIG. 13, where the appendage 70 is folded and stored within the cavity 68. The appendage 70 is secured to one end 72 of a sleeve 74 which has a plurality of retention means in the form of triangular fins, 76, forwardly inclined for ease of entry and difficulty of extraction with the foam of a tube of flexible sheet material, e.g., paper, plastic or fabric, is secured over end 72 of the sleeve 74, and the sleeve 74 is forcefully inserted into the cavity 68, where it is permanently retained, lining the cavity wall. The sleeve 74 is illustrated in greater detail in FIGS. 14 and 15. As shown in FIG. 14, the triangular fins 76 are located on the forward end 80 of the sleeve 68, arranged in four rows, of two fins each, which are spaced apart at 90 degree angular increments. The sleeve 74 can be formed of a single piece construction with integral fins. The tail end 72 of the sleeve 74 provides a surface to which the tubular appendage is secured, either by stretching the appendage, if formed of elastic material, or by an adhesive applied between the mating surfaces of the sleeve and appendage.

It is desirable to provide appendages which can be attached to existing footballs, so that the user can modify their ball to have the stabilizing benefits of the appendage. FIG. **16*a* shows a number of appendage 100 embodiments which can be attached to the end of a football 102. The appendage 100 may be attached to a cup 104 which may be adhered with a glue, tape, etc. to the end of the football 102, to couple the appendage 100 to the ball 102. The cup 104 is preferably constructed from a plastic, vinyl or rubber material. The appendage 100 may also be connected to a C-shaped clip 106, a star shaped clip 108 or a noose 110 which can may be adhered with a glue, tape, etc. onto the end of the ball 102. The clips 106 and 108 are preferably constructed from a vinyl, fabric or leather material. The noose 110** is preferably constructed as a single loop of elastic, vinyl or nylon material which is attached at its ends by snaps, or hook and loop material.

The attachment members 104–110 allow the user to readily attach and remove the appendage 100 from a football. The attachment members 104–110 are constructed to allow the appendage 100 to be attached and removed from the football 102 without modifying or damaging the ball 100.

As shown in FIG. **16*b*, the appendage 100 can be connected to the attachment members 104–110 by snaps, or hook and loop material 112, which allows the appendage to be easily removed from the football 102 without having to remove the members 104, 106, 108 or 110**.

Figure 17:
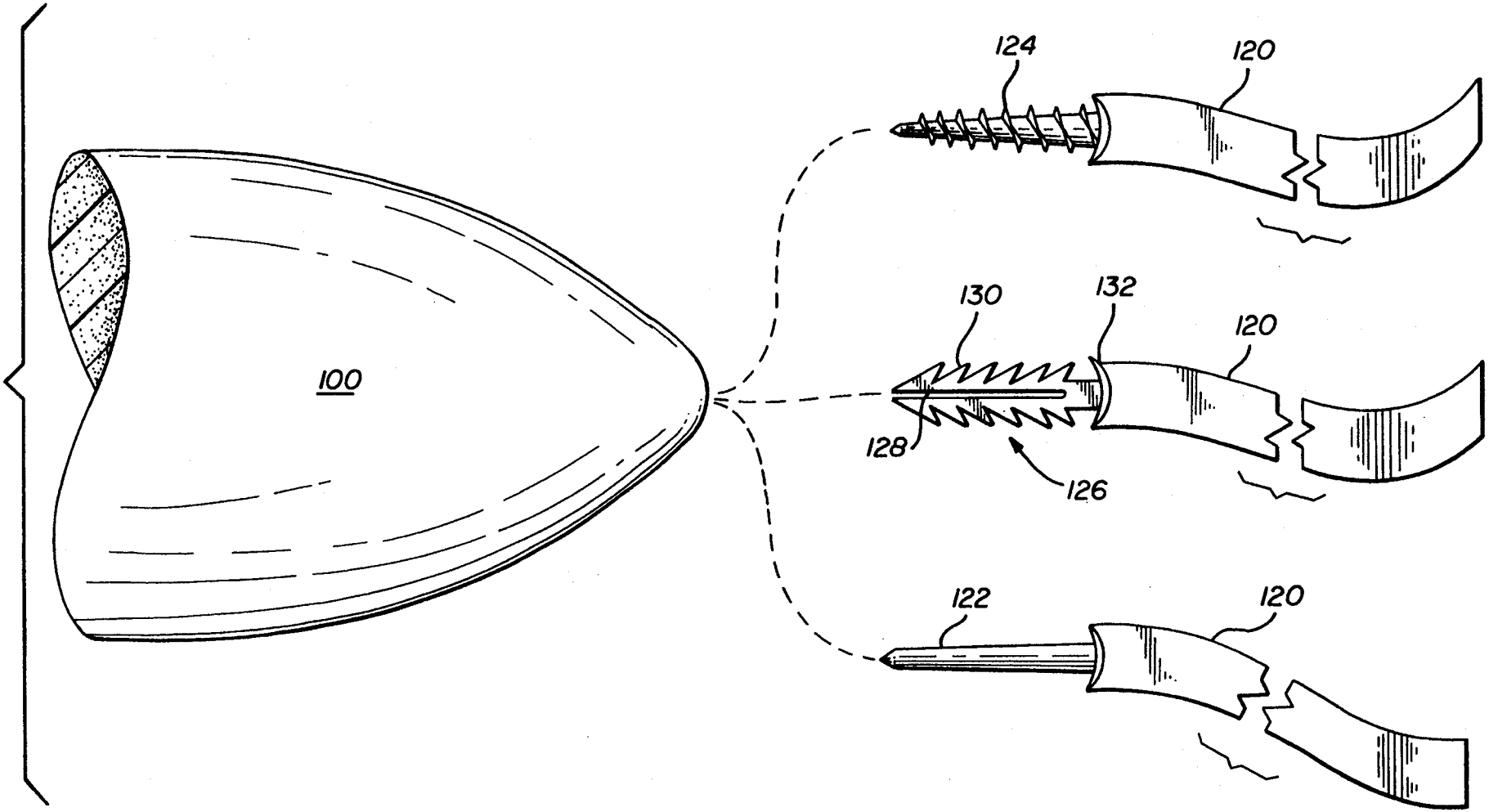
FIG. 17 illustrates alternate embodiments of appendages which can be detachably attached to a football by inserting an insert into the ball.

FIG. 17 shows alternate embodiments of a detachable appendage 120 which has an insert that is inserted into the football 100. The football 100 is preferably constructed from a foam material which allows the user to manually install the insert. The insert may be a simple pin 122, a threaded screw 124 or a barbed anchor 126 which has a slit 128 that allows the fingers 130 of the anchor 126 to expand within the football. The appendage 120 may be attached to a cup 132 that is formed into the inserts 122–126 and which conforms to the shape of the ball 100. The appendage 120 is attached to the football by merely pushing the insert into the end of the ball. The appendage can be removed by pulling the insert out of the ball. The appendage may be permanently attached to the football by applying a glue to the insert before insertion into the ball. The inserts may also be inserted into the bottom 69 of the opening 68 showing in FIG. 12.

Figure 8:
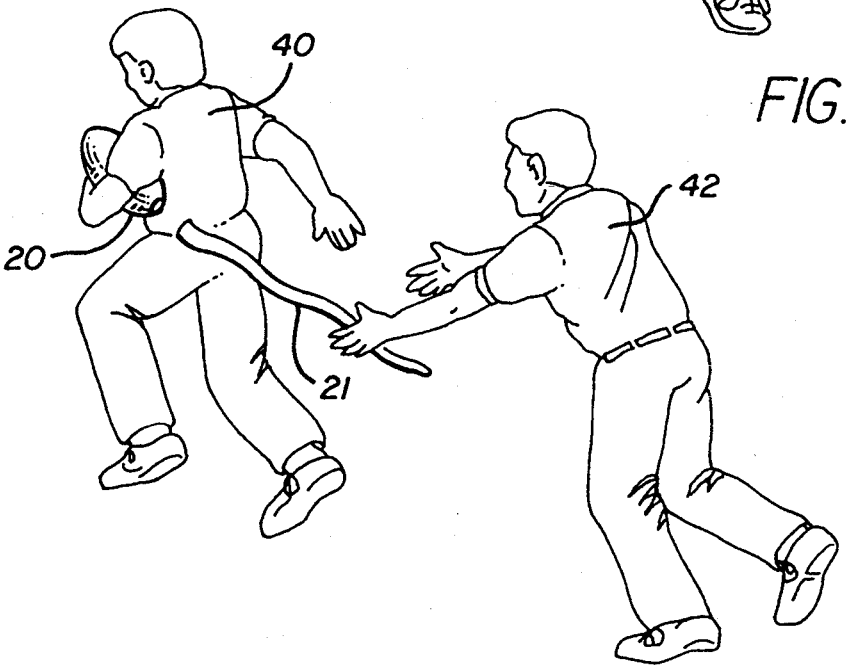
FIG. 8 illustrates two children playing a game involving the football of the invention.

The first game of the invention would require a player to catch the ball in mid-air by the tail so that the tail is removed in order to score points. Many football game variants have been developed over the years in an effort to avoid or eliminate the dangers associated with the bodily contact inherent to actual football. One such variant, commonly called "Flag Football", is played by children, and involves chasing the opponent player who is holding the ball, and then grabbing a cloth or vinyl flag or streamer attached to that player to signify a tackle. This game requires many flags or streamers attached to many different players. The second game of this invention, as illustrated in FIG. 8, can be played like Flag Football, except that the special football 20 of the invention, with its extended tail 21, would be held by the runner 40. An opponent 42 grabbing and removing the ball's tail 21 would signify a safe "tackle".

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A football, comprising:

a football having two opposite ends located on a longitudinal axis;

a flexible appendage that has a first end attached to one end of said football by interlocking hook and loop material on said one end of said football and said first end of said appendage, and a second opposite end that is not attached to any structure, wherein said flexible appendage provides aerodynamic stability for said football in flight.

* * * * *